US006045102A

United States Patent [19]

Terenzoni

[11] Patent Number: 6,045,102

[45] Date of Patent: Apr. 4, 2000

[54] MULTI-PURPOSE LADDER AND ROOF DEVICE

[76] Inventor: Robert Terenzoni, 98 Boston Ave., Medford, Mass. 02155

[21] Appl. No.: 09/015,389

[22] Filed: Jan. 29, 1998

[51] Int. Cl.[7] ..... A47G 29/02

[52] U.S. Cl. ..... 248/238; 248/148; 248/211; 248/237; 182/45; 182/117; 182/121; 182/107

[58] Field of Search ..... 248/238, 237, 248/148, 210, 211, 536; 182/45, 117, 121, 107

[56] References Cited

U.S. PATENT DOCUMENTS

| | | | |
|---|---|---|---|
| 363,483 | 5/1887 | Ramsey | 182/121 |
| 960,565 | 6/1910 | Levander | 182/45 |
| 1,143,678 | 6/1915 | Winans | 248/238 |
| 1,501,298 | 7/1924 | Armitage | 248/238 |
| 2,067,188 | 1/1937 | Hennessy | 248/238 |
| 2,888,225 | 5/1959 | McQuin | 182/45 |
| 4,542,874 | 9/1985 | Rönning | 248/238 |
| 4,946,123 | 8/1990 | Albert | 248/237 |
| 5,020,757 | 6/1991 | Sulecki et al. | 248/238 |
| 5,446,969 | 9/1995 | Terenzoni | 33/419 |

OTHER PUBLICATIONS

Jay Klein, Safe Scaffolding Options, Dec., 1996, p. 35 and palce of publication: Richmond Vermont.

Lyn–Lad Company, Brackets/Jacks, pp. 36 and 37 and place of publication West Lynn, Massachusetts.

*Primary Examiner*—Anita M. King
*Assistant Examiner*—Gwendolyn Baxter
*Attorney, Agent, or Firm*—Bourque & Associates, PA

[57] ABSTRACT

The multi-purpose Combo Jack™ tool combines the functions of a ladder jack, a roof bracket and a roof hooks into one piece of equipment. There are a pair of hooks attached to a rail supporting arm which is pivotably connected to a bracket body arm. The bracket body arm includes the plank stop lever and a retractable nailing blade. A combination support arm is connected to the rail support arm at either the tri-function setting or the steep roof bracket setting, and is also connected to the upward or downward slots in the bracket body arm (or at the end but not in a slot). The tool includes a safety stop as part of the retractable nailing blade, a ladder lock, and a safety protrusion to prevent collapse of the tool because of slippage along the bracket body arm by the combination support arm.

40 Claims, 10 Drawing Sheets

MULTI-PURPOSE LADDER AND ROOF DEVICE

FIELD OF THE INVENTION

This invention relates to construction tools and more particularly, to a multi-purpose roof and ladder device which can serve as a ladder jack, a roof bracket and a roof hook.

BACKGROUND OF THE INVENTION

People in the construction industries use a variety of specialized equipment and stagings which are particular to certain jobs. Often the jobs are not done while standing on the ground. Rather, the work must be done while standing on a ladder supported platform or on a roof. For reasons of safety and economy, specialized equipment such as ladder jacks, roof brackets and roof hooks have been developed. Each piece of equipment is useful for its one particular function and only that one function. Thus, the construction industry requires a large amount of specialized equipment.

Ladder jacks, which are also known as ladder brackets, are set up by placing two or more ladders near each other, attaching a ladder bracket to each ladder and a plank is placed on the ladder brackets so as to form a raised platform. Such a platform is useful for working on the sides of houses and buildings. U.S. Pat. Nos. 4,542,874 and 5,020,757 are examples of prior art ladder jacks.

Roof brackets are set up by attaching the roof brackets to the roof by nails or the like, and then putting a plank platform and railings on the roof brackets. This provides safety and a level surface while working on roof tops and the like.

Roof hooks, which are also know as ridge hooks, are set up by placing the roof hook straddling the ridge of a roof, then possibly nailing the roof ladder hook into place, and then placing a ladder over the roof hook. This provides a quick and easy way to access a steep roof.

The purchasing and transporting of numerous pieces of specialized equipment to or between job sites can be time consuming as well as expensive. Thus, when equipment can be used for multiple jobs, time and money are saved.

At the present time, ladder jacks, roof brackets and roof hooks are used in the construction industry. Each of these pieces of equipment is utilized for one particular job but cannot be substituted for one of the other pieces of equipment. Thus, it would be highly advantageous to have one piece of equipment which could be utilized as a ladder jack, roof bracket and roof hook.

SUMMARY OF THE INVENTION

The present invention accordingly features a multi-purpose roof and ladder device. The device has a first member (also referred to as a rail support arm), a second member (also referred to as a bracket body arm) and a third member (also referred to as a combination support arm). The first member is pivotally connected to the second member. The first member includes one or more settings to engage with the third member. The second member has a series of slots that engage with the third member. Thus, the third member is adjustable with the first and second members, and an "A" or "Δ" is formed by the three members.

The slots in the second member are separated into at least two regions. The first region is slanted in a direction different than the first region such that the third member pushes on the slots in the first region (also referred to as a ladder jack slot settings) and pulls on the slots in the second region (also referred to as a roof bracket and roof hook slot settings). The first member typically includes a ladder hook and a ladder/rail hook. The hooks can be of various shapes including rectangular and U-shaped. The hooks can also include holes for the driving of nails into a wooden railing or the like. A ladder hook or ladder/rail hook can be connected to a ladder or railing. The railing may be a wooden two-by-four.

Another important feature is a ladder lock disposed just above the opening of one of the hooks so to lock a ladder into place. The ladder lock typically includes a resilient component such as a spring or the like.

The second member includes a plank stop lever. The plank stop lever can also be fixed to or detachable from the second member. Typically, the plank stop lever is movably fixed to the second member. A lever locking bolt or the like allows movement of the plank stop lever.

Another feature of the present invention is a roof attachment member (also referred to as a nailing blade). The roof attachment member facilitates attachment to a roof or any similar structure. The roof attachment member is coupled to the second member, preferably in a moveable or slideable manner. The slideable roof attachment member further includes an extended portion (also referred to as a safety stop) so that the third member cannot be put into an inappropriate slot, thereby preventing accidents.

The second member also includes a protrusion, such as a bolt, nut or the like, which prevents the third member, which has an adjustment member or device, from accidentally sliding between the first and second regions. The first and second regions contain slots going in different directions. Since the adjustment member or device must be loosened prior to moving the combination support arm between the first and second regions, the device cannot accidentally jump from one region to another, thus preventing accidents.

The third member attaches the first member at one or more positions. The additional positions provide greater flexibility in using the device. Specifically, it allows the user to have a greater selection of angles upon which the device may be used and maintained level with the ground. The third member is coupled by means of an adjustment member or device, such as a locknut or the like. The adjustment member or device slides along a slot or groove, and then is placed into one of a series of slots. A number of the slots are initially aligned along a first longitudinal axis in one general direction, while other slots are aligned along a second longitudinal axis in a second general direction, thereby providing multiple functions. These functions include a ladder jack, a roof racket and a roof hook.

While the invention is preferably utilized with all of the features used as described in the drawings, it is possible to reverse some of the features on the first and second members. Specifically, the slot settings could be placed on the first member rather than the second member while the tri-function settings and the steep roof bracket settings could be placed on the second member instead of the first member. It is also contemplated that the invention does not need to be utilized with all of the features. Instead, the invention may be utilized with only some of the features in any of numerous combinations.

DESCRIPTION OF THE DRAWINGS

These, and other features and advantages of the present invention will be better understood by reading the following detailed description, taken together with the drawings wherein.

DETAILED DESCRIPTION OF THE INVENTION

Figure 1:
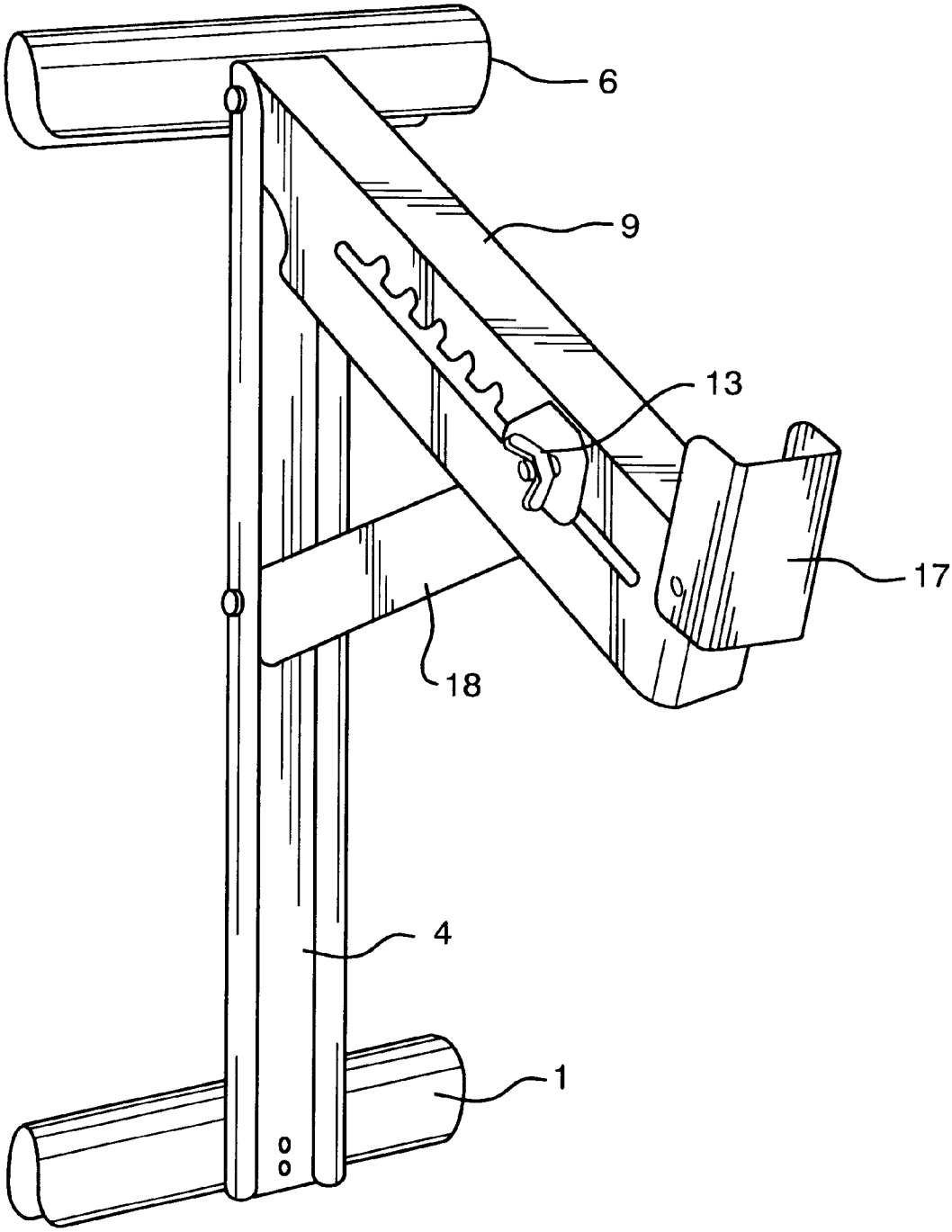
FIG. 1 (PRIOR ART)
FIG. 1 is a prior art ladder jack.

Prior art FIG. 1 shows a ladder jack sold by the Lynn Ladder and Scaffolding Co., Inc.. The prior art ladder jack includes a plank stop 17, a ladder hook 6, a ladder/rail hook 1, a support arm 18, a bracket body arm 9, an adjustment locknut 13, and a rail support 4. However, the prior art provides only the ladder jack function. The present invention can be practiced by modifying this prior art device.

Figure 2:
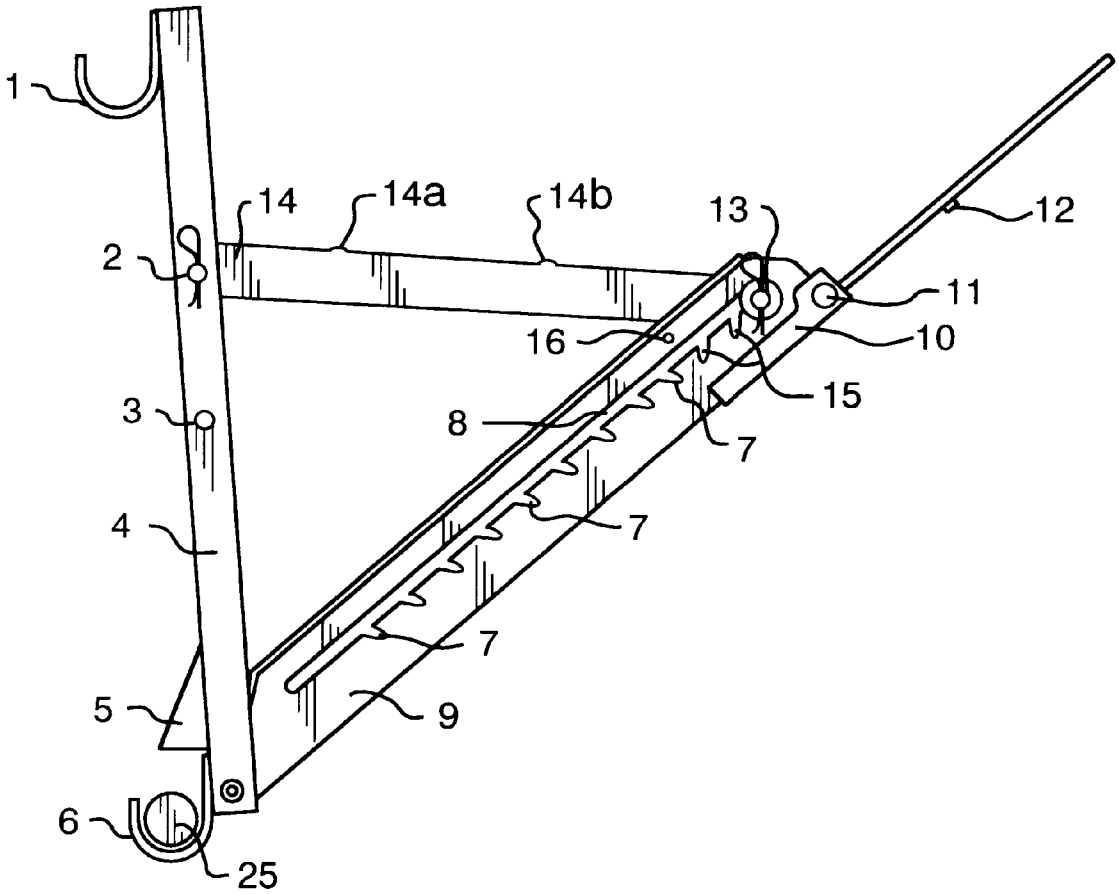
FIG. 2 is a side view of the present invention set up as a roof bracket on a steeply inclined roof.

The multi-purpose ladder and roof device 50, FIG. 2, according to one embodiment of the present invention, is configured as a roof bracket to be utilized on an inclined roof and includes a ladder/rail hook 1, a steep roof bracket setting 2, a tri-function setting 3, a rail support arm 4, a ladder lock 5, a ladder/rail hook 6, ladder jack slot settings 7, a safety stop portion 8 of the nailing blade 12, a bracket body arm 9, a plank stop lever 10, a lever lock device or bolt 11, a nailing blade 12, an adjustment locknut 13, a combination support arm 14, roof bracket and roof hook slot settings 15, and safety nut 16.

The steep roof bracket setting 2 permits the user to utilize the present invention on a steeply inclined roof. The ladder lock 5 provides additional safety by preventing a ladder rung 25 (shown in phantom) from accidentally jumping free of the ladder/rail hook 6 and causing an accident. The ladder lock 5 includes a resilient component, such as a spring, for maintaining the ladder lock in a locked position. The ladder lock resilient component is compressible for moving the ladder lock 5 to an open position for allowing an object, such as ladder rung 25, to be inserted and removed from the ladder hook 6. Nailing blade 12 facilitates secure attachment of the multi-purpose ladder and roof device to the roof. Attachment to the roof is preferably accomplished with nails but may also be accomplished with screws or similar means. Additionally, the safety stop 8 on the nailing blade 12 prevents utilization of the roof bracket, function with the ladder jack slot settings 7 since the extended nailing blade 12, which includes the safety stop 8, physically prevents the combination support arm 14 from being moved out of the roof bracket and roof hook slot settings 15.

Located on the bracket body arm 9 is a safety stop device 16 that prevents the accidental slippage of the combination support arm 14 between the ladder jack slot settings 7 and the roof bracket and roof hook slot settings 15. The safety stop device 16 may be a nut and bolt, screw, an extension of the bracket body arm 9 or other arrangement that provides a raised surface or device that prevents the adjustment device 13 from slipping between the settings 7 and 15. The support arm 14 can also include one or more raised portions or dimples 14*a*, 14*b*, for preventing a plank from sliding when supported by the support arm 14.

The ladder/rail hook 6 is shown adjacent the bracket body arm 9 and the ladder/rail hook 1 at the opposite end of the rail support arm 4. However, the placement of the ladder/rail hooks 1 and 6 could be reversed, and in addition, there can be a ladder lock 5 for each ladder/rail hook 6. The ladder hooks 1 and 6 can be "U" shaped, rectangular or any similar shape. The ladder/rail hooks 1 and 6 may also include holes allowing a railing to be attached by nails, screws or the like to the ladder/rail hooks 1 and 6 as will be explained further below.

The rail support arm may include multiple tri-function settings 3 or multiple steep roof settings 2 for greater versatility. The number of slot settings 7 and 15 may also be increased for greater versatility.

Alternatively, the slot settings 7 and 15 could be on the rail support arm 4 and the steep roof and tri-function settings 2 and 3 could be on the bracket body arm 9. This arrangement is disadvantageous because the safety stop 8 is separate from the slot settings 7 and 15 which eliminates an important safety feature.

Figure 3:
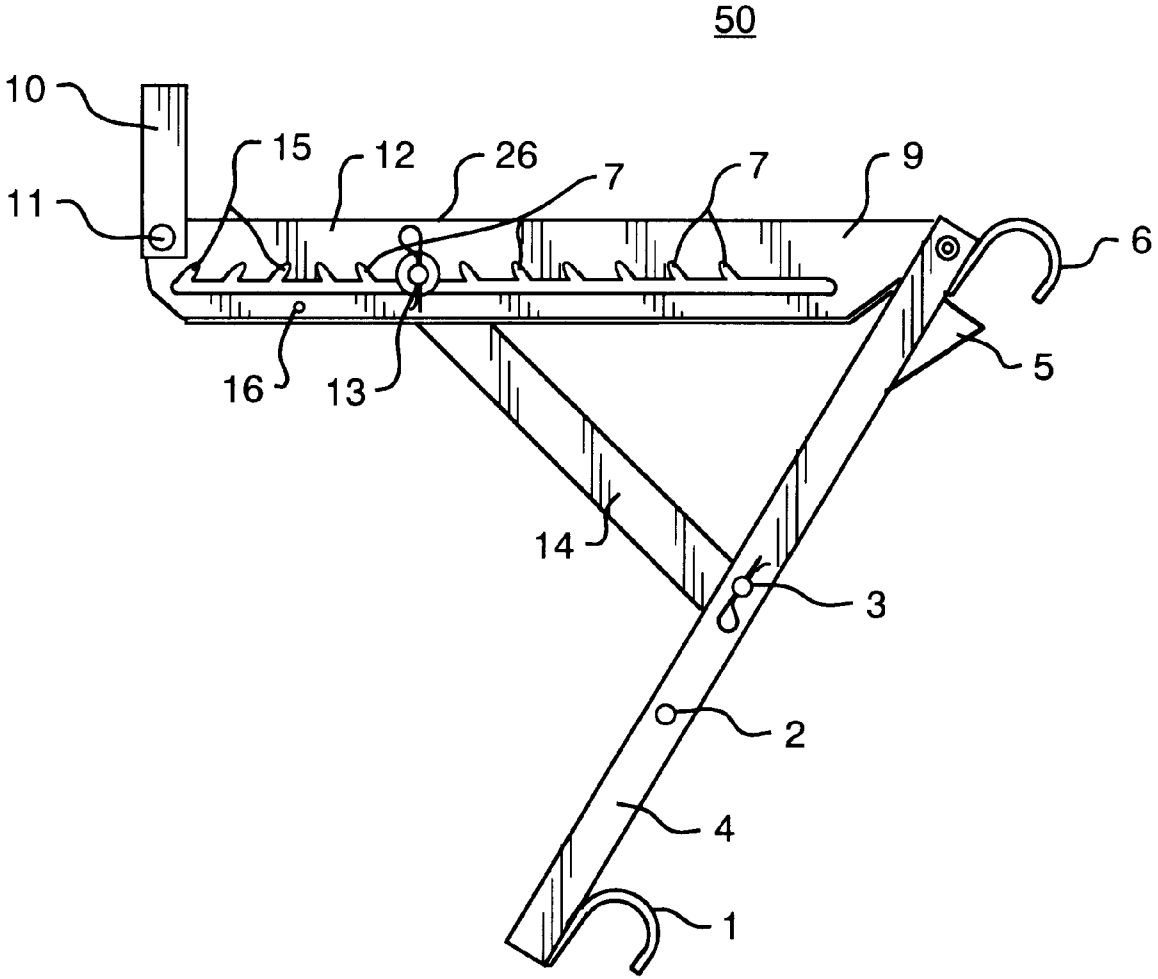
FIG. 3 is a side view of the present invention set up as a ladder jack.

The multi-purpose ladder and roof device 50, FIG. 3, is set up as a ladder jack and has the same elements, features and advantages as shown in FIG. 2 except for the following. The tri-function setting 3 is used instead of the steep roof bracket setting 2, the nailing blade 12 has been retracted so that the ladder jack slot settings 7 may be used, and the plank stop lever 10 has been put into the "up" position. The top surface 26 of the bracket body arm 9 opposite the combination support arm 14 will support one end of a platform. The platform can be a wooden plank 22 or the like. The platform is usually supported by two multi-purpose ladder and roof devices 50, and may sometimes be supported by three or more multi-purpose ladder and roof devices 50. The plank 22 is prevented from falling off the bracket body arm 9 on one side by the ladder in ladder/rail hooks 1 and 6, and on the other side by the plank stop lever 10. The plank stop lever 10 maintains its position due to a lever lock bolt 11 which restricts the movement of the plank stop lever 10.

The ladder jack slot settings 7 differ from the roof bracket and roof hook slot settings 15 by the orientation of the slots. The ladder jack slot settings 7 point towards the connecting point of the bracket body arm 9 and the rail support arm 4 so as to prevent the bracket body arm 9 and the rail support arm 4 from coming together during use as a ladder jack. Safety stop device 16 prevents adjusted device or member 13 from passing into the roof bracket and roof hook settings 15. This is an additional safety feature.

The roof hook and roof bracket functions differ in that the roof hook slot settings 15 point away from the connecting point of the bracket body arm 9 and the rail support arm 4 so as to prevent the bracket body arm 9 and the rail support arm 4 from coming apart.

Figure 4:
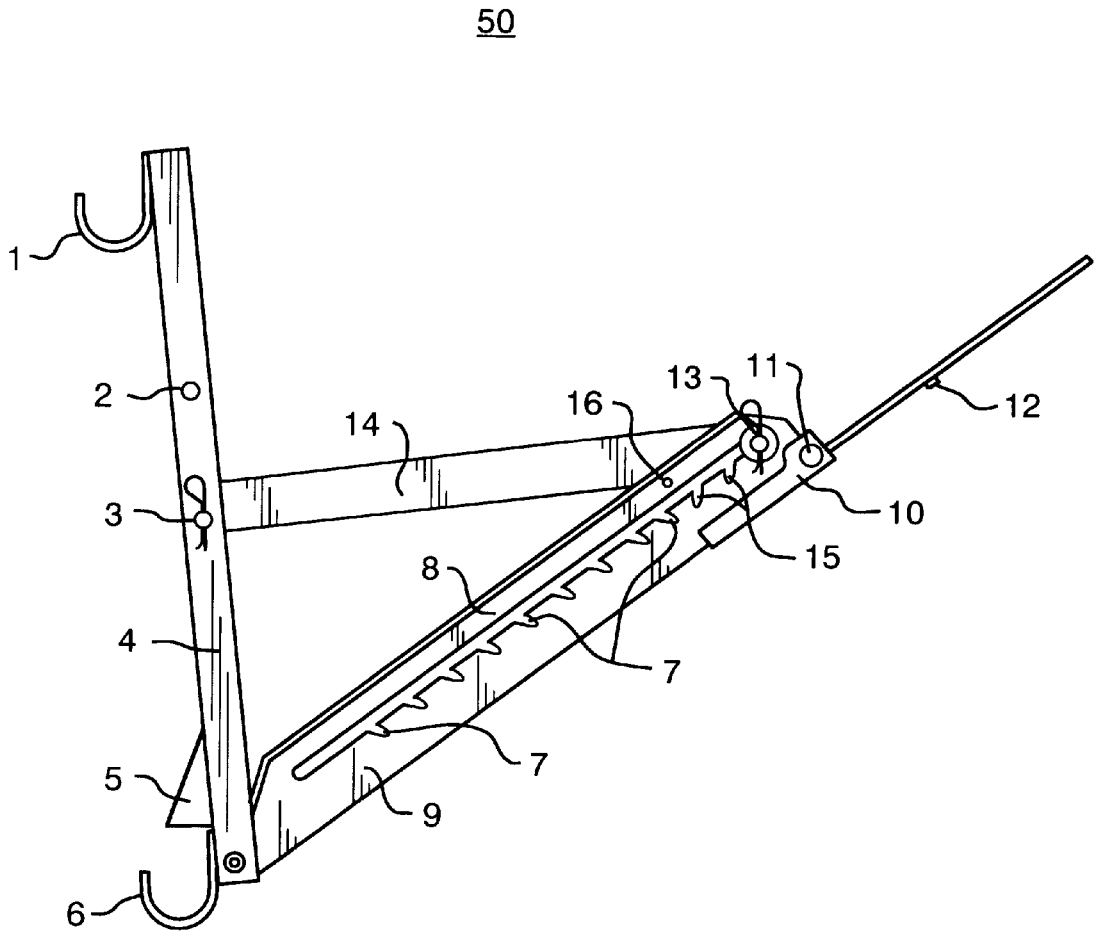
FIG. 4 is a side view of the present invention set up as a roof bracket or as a roof hook.

The multi-purpose ladder and roof device 50, FIG. 4, is shown set up as a roof bracket or ridge hook and includes the same elements, features and advantages as in the previous figures except that the tri-function setting 3 is utilized instead of the steep roof setting 2. This configuration permits utilization of the multi-purpose ladder and roof device 50 of the present invention as a roof hook and as a roof bracket.

Figure 5:
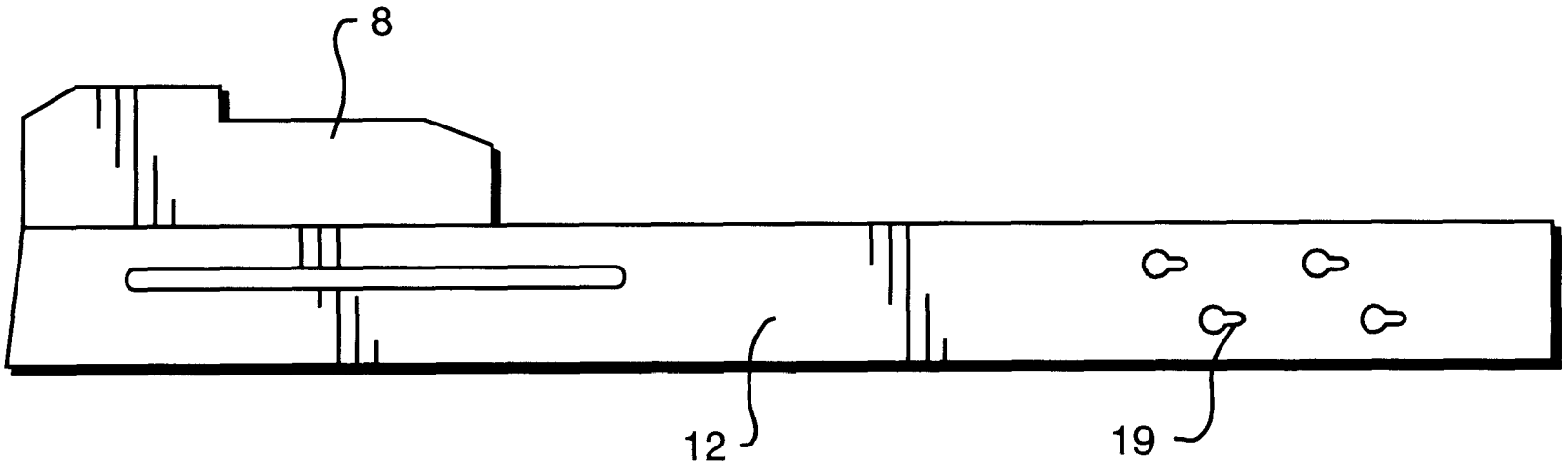
FIG. 5 is a side view of a nailing blade including a safety stop.

FIG. 5 shows the nailing blade 12, the nailing blade holes 19 and the associated nailing blade safety stop 8. The safety stop 8 has increased height so that when the nailing blade 12 is extended from the bracket body arm 9, the adjustment device or member 13 must be in the roof bracket and roof hook slot settings 15 because the safety stop 8 bounds the allowable range of movement.

A prior art ladder jack, such as shown in FIG. 1, can be retrofitted to produce the multi-purpose ladder and roof device 50 of the present invention. The present invention contemplates a nailing blade 12 that is fixed, movable by sliding or rotating (like opening a pocket knife), and/or detachable.

Figure 6:
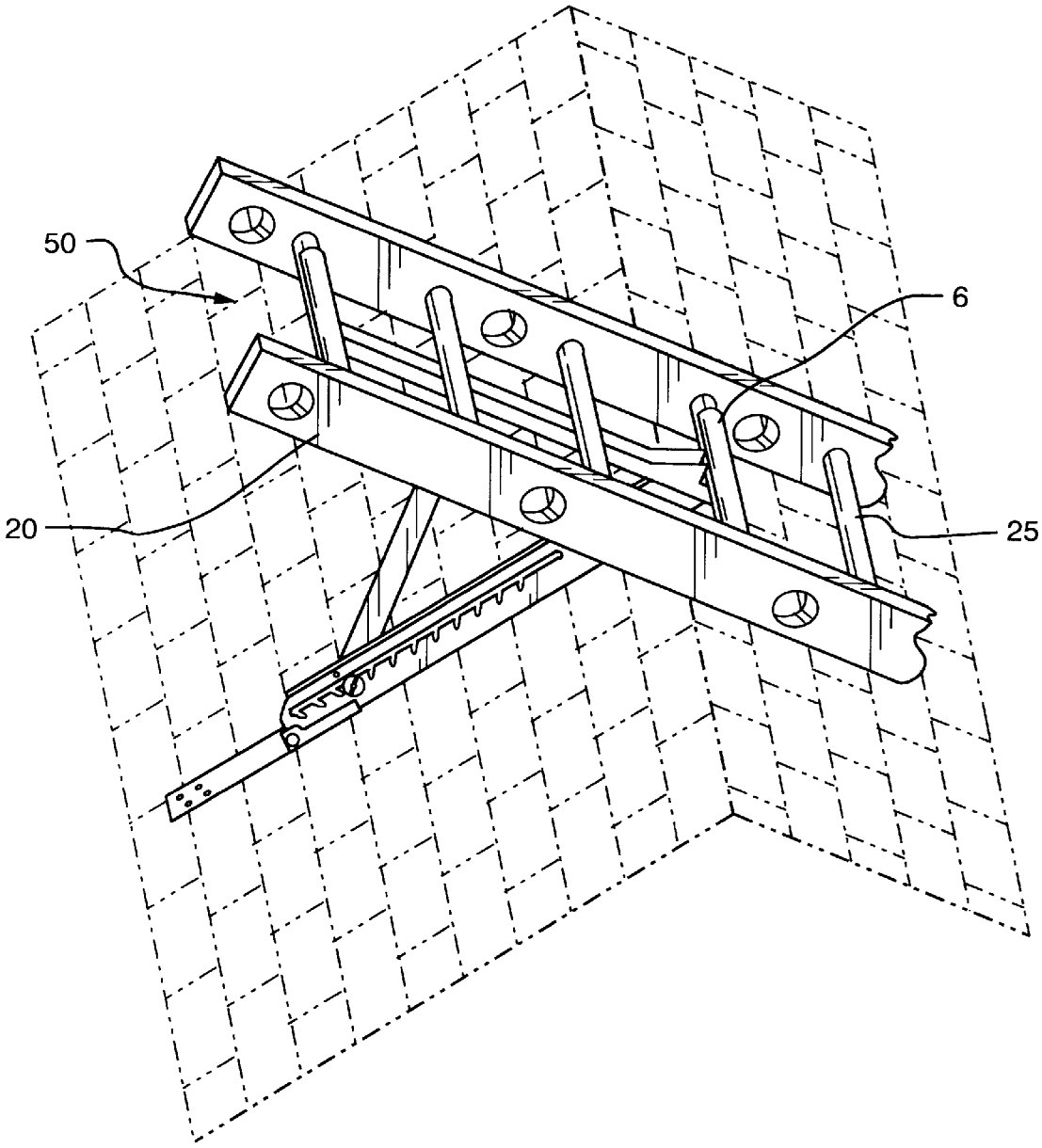
FIG. 6 is a view of the present invention set up as a roof hook.

FIG. 6 shows the multi-purpose ladder and roof device 50 of the present invention utilized as a roof hook. The invention is placed at the ridge 30 of a roof 21 with a ladder 20 on one side of the ridge 30 and the multi-purpose ladder and roof device 50 of the present invention on the other side of the ridge 30. The nailing blade 12 may be used to securely fasten the multi-purpose ladder and roof device 50 to the roof 21 by means of nails, screws, or the like.

To utilize the present invention as a roof hook, it is necessary to place the plank stop lever 10 in the down position and to place the ladder rungs 25 into the ladder/rail hooks 1, 6 of the present invention. The multi-purpose ladder and roof device 50 is then adjusted to the desired setting and adjustment device or member 13 is tightened.

Figure 7:
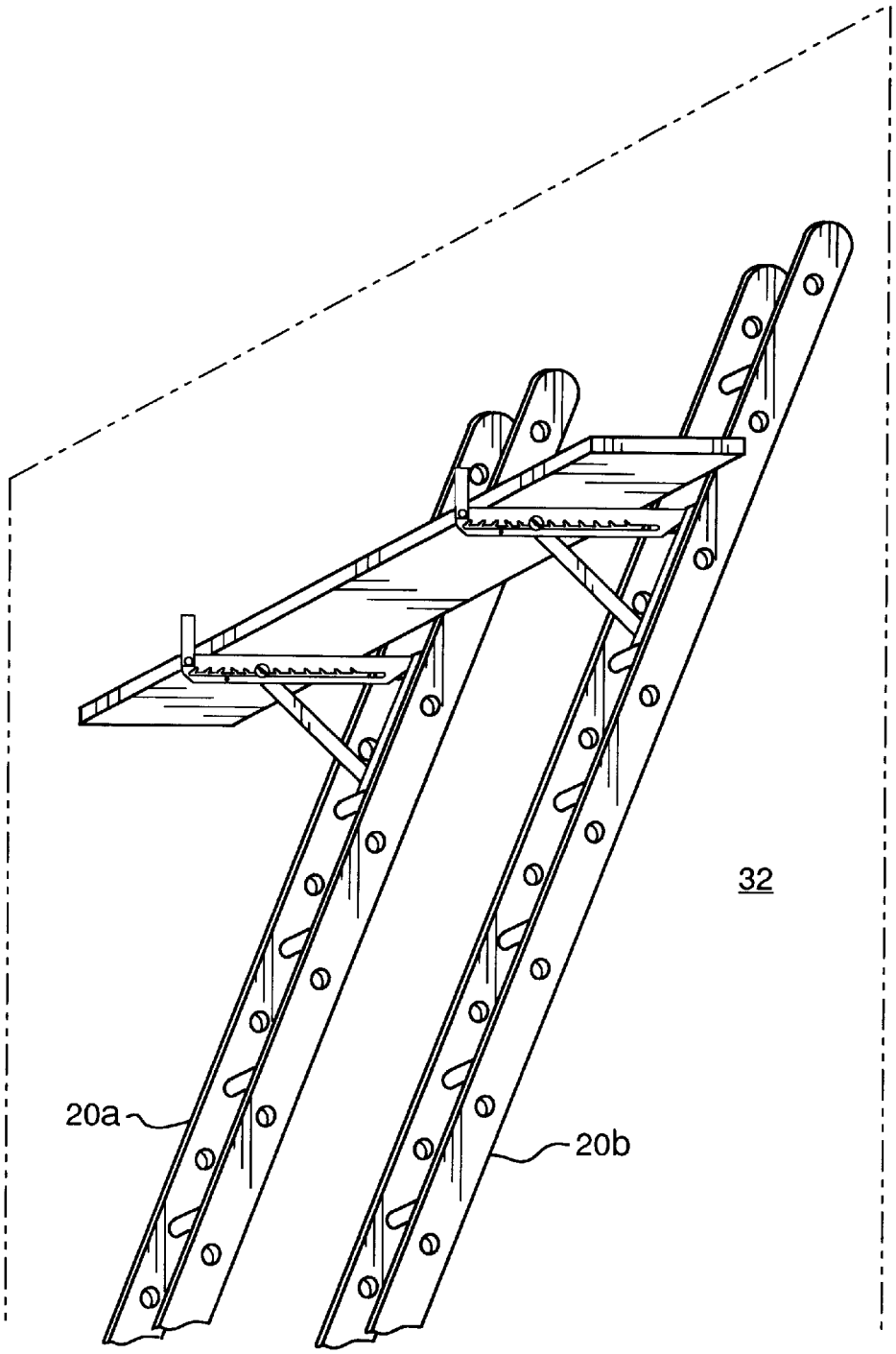
FIG. 7 is a view of the present invention set up as a ladder jack with the ladder between the wall and the ladder jack.

FIG. 7 shows the two multi-purpose ladder and roof devices 50 of the present invention utilized as ladder jacks with ladders 20*a* and 20*b* between a wall 32 and the plank 22 which forms the platform. In setting up this embodiment, the nailing blade 12 should be retracted and the plank stop lever 10 placed in the upright position. The combination support arm 14 should be affixed to the tri-function setting 3 on the rail support arm 4. The adjustment device should be tightened after placing the combination support arm 14 into an appropriate ladder jack slot setting 7. This is repeated for a second ladder 20*b* and then a plank 22 is placed between and on each of the multi-purpose ladder and roof devices used as ladder jacks. Plank 22 is then usable as a platform.

Figure 8:
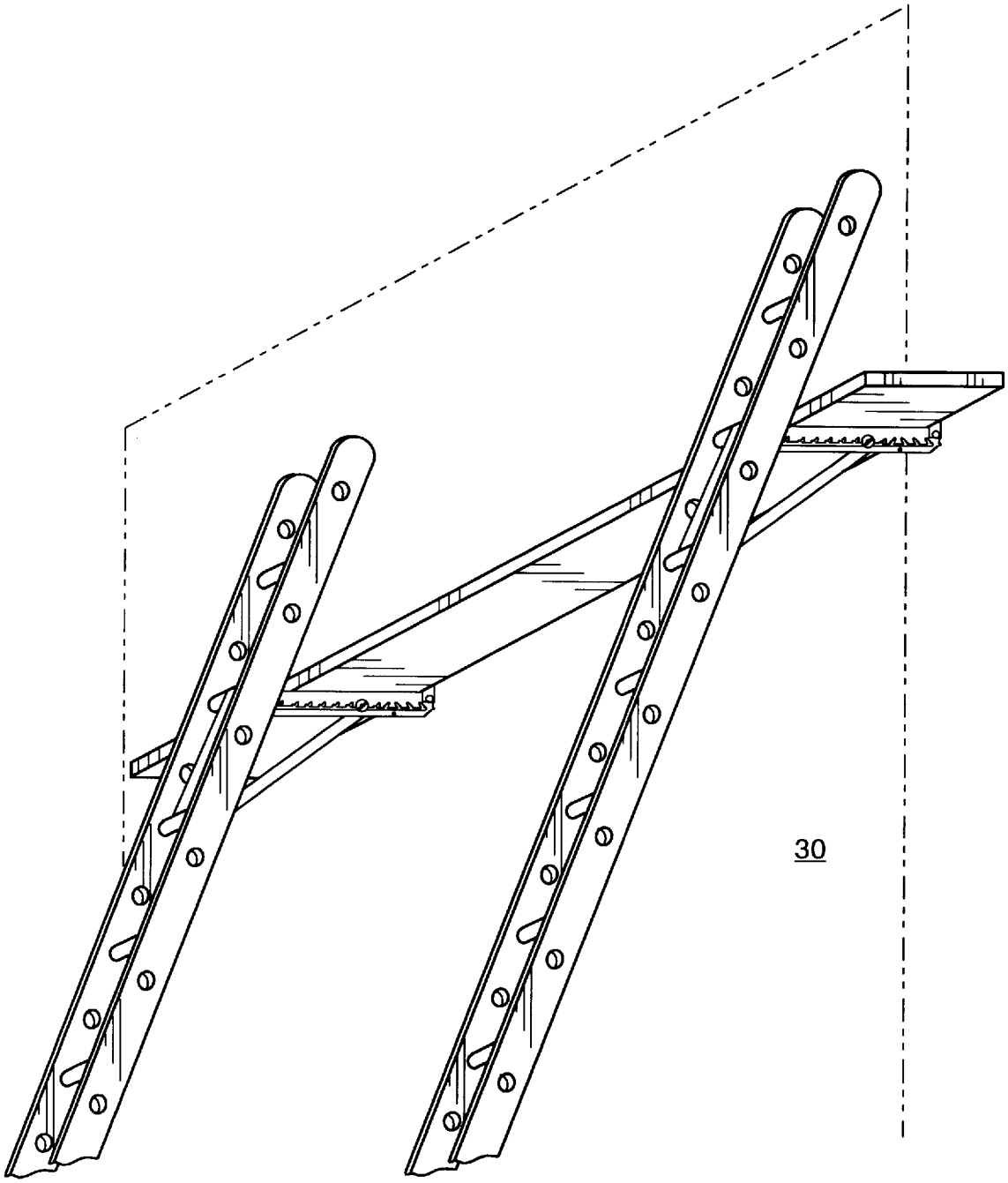
FIG. 8 is a view of the present invention set up as a ladder jack with the ladder jack between the wall and the ladder.

FIG. 8 illustrates the multi-purpose ladder and roof device 50 used as a ladder jack as in FIG. 7 except that the platform 28 is between the ladders 20 and the wall 30.

Figure 9:
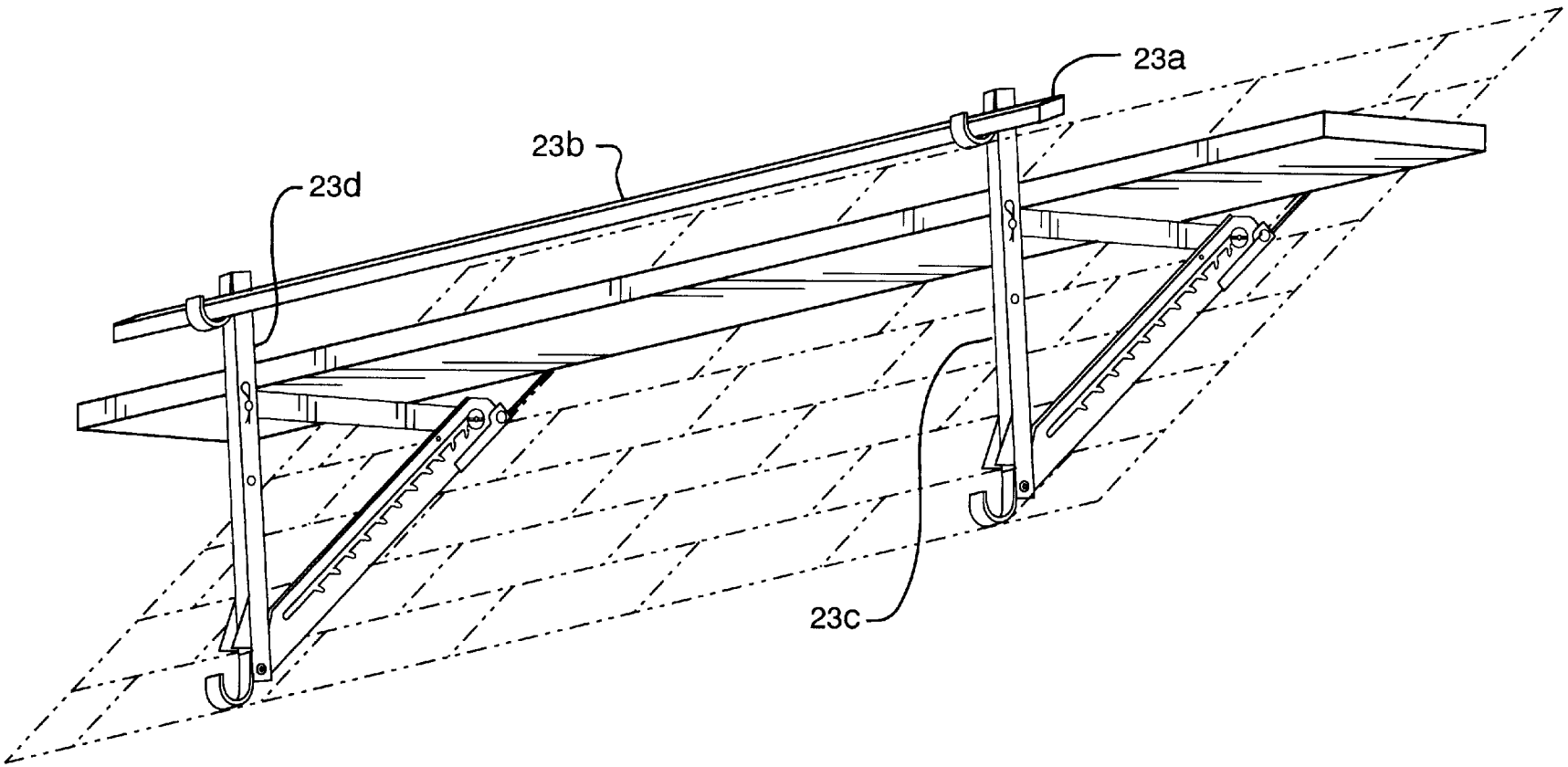
FIG. 9 is a view of the present invention set up as a roof bracket.

FIG. 9 shows the multi-purpose ladder and roof device 50 of the present invention utilized as a roof bracket. In this embodiment, the plank stop lever 10 is set in the down position, the combination support arm 14 is placed into one of the roof bracket settings 15 and then the adjustment device or member 13 is tightened. The nailing blade 12 is then pulled out of the bracket body arm 9 and is attached to the roof 21. Additionally one or more railings 23*a*–23*d* may be placed in the hooks.

Figure 10:
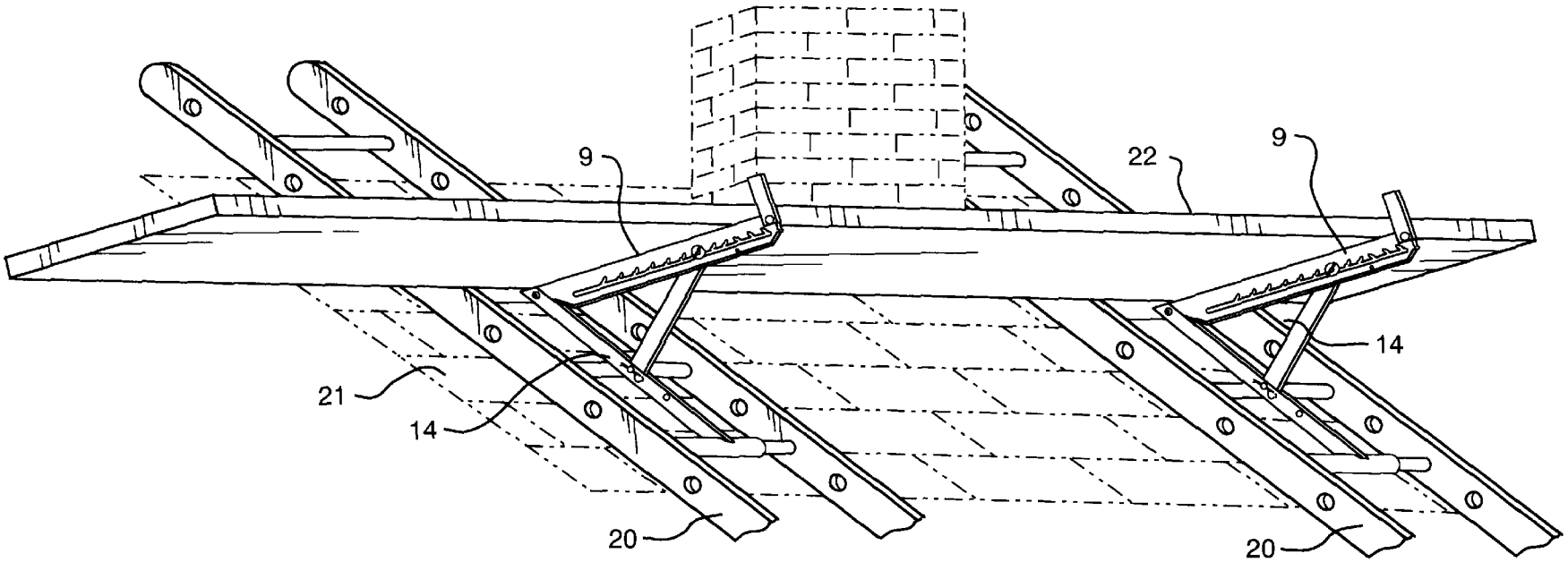
FIG. 10 is a view of the present invention set up as a ladder jack without engaging with any of the slot settings.

FIG. 10 shows the multi-purpose ladder and roof device 50 of the present invention utilized as a ladder jack on a roof 21. Except for the invention being used on a roof 21 instead of next to a wall, the invention is configured and utilized in generally the same manner as shown in FIG. 7. Additionally, utilization on a roof 21 allows the combination support arm 14 to go to the far end of the bracket body arm 9 instead of engaging with one of the ladder jack slot settings 7. This allows a platform to be generally level given the roof slope.

Accordingly, the multi-purpose ladder and roof device of the present invention provides a single device that has multiple uses as a ladder jack, roof bracket, and roof hook. Furthermore, existing ladder jacks can be modified according to the method of the present invention to be used as a multi-purpose ladder and roof device.

Modifications and substitutions by one of ordinary skills in the art are considered to be within the scope of the present invention which is not to be limited except by the claims which follow.

What is claimed is:

1. A multi-purpose roof and ladder device comprising:

a first member having first and second engaging regions, said first engaging region including at least first and second engagement settings;

a second member having a longitudinal axis and first and second engaging regions, said first engaging region pivotally connected to said second engaging region of said first member, said second engaging region of said second member including a first set of at least one engaging slot disposed at an acute angle relative to said longitudinal axis, and a second set of at least one engaging slot disposed at an obtuse angle relative to said longitudinal axis; and a third member having first and second engaging regions, said first engaging region having an engaging mechanism for engaging one of said at least first and second engagement settings of said first engaging region of said first member, said second engaging region having an engaging mechanism for selectively engaging one engaging slot from said first and second sets of at least one engaging slot of said second engaging region of said second member.

2. The multi-purpose roof and ladder device of claim 1, wherein said first member further includes at least one hook.

3. The multi-purpose roof and ladder device of claim 2, wherein said at least one hook is rectangular or U shaped.

4. The multi-purpose roof and ladder device of claim 2, wherein said at least on hook includes holes.

5. The multi-purpose roof and ladder device of claim 2, wherein said first member includes a ladder lock disposed proximate said at least one hook.

6. The multi-purpose roof and ladder device of claim 5, wherein said ladder lock includes a resilient component.

7. The multi-purpose roof and ladder device of claim 1 further comprising a plank stop coupled to said second member.

8. The multi-purpose roof and ladder device of claim 7, wherein said plank stop is movable.

9. The multi-purpose roof and ladder device of claim 8, wherein said plank stop includes a lever locking device.

10. The multi-purpose roof and ladder device of claim 1, further comprising a roof attachment member coupled to said second member.

11. The multi-purpose roof and ladder device of claim 10, wherein said roof attachment member is movably coupled to said second member.

12. The multi-purpose roof and ladder device of claim 11, wherein said roof attachment member includes an extended portion to prevent said engaging mechanism of said second engaging region of said third member from moving between said first and second sets of at least one engaging slot on said second member while said roof attachment member is utilized.

13. The multi-purpose roof and ladder device of claim 11, further comprising a movable plank stop coupled to said second member.

14. The multi-purpose roof and ladder device of claim 1, further comprising a movement restrictor adjacent said first and second sets of at least one engaging slot of said second member to prevent said engaging mechanism of said second end of said third member from accidentally moving between said first and second sets of at least one engaging slot of said second member.

15. A multi-purpose roof and ladder device comprising:

a first member, a second member and a third member;

a first end of said first member coupled to said second member;

said first member coupled to said third member;

said third member adjustably coupled to said second member;

a movable roof attachment member movably attached to said second member for connection to a roof; and a coupling member disposed on said first member for connection to a weight supporting member.

16. The multi-purpose roof and ladder device of claim 15, wherein said coupling member further includes at least one hook.

17. The multi-purpose roof and ladder device of claim 16, wherein said at least one hook includes holes.

18. The multi-purpose roof and ladder device of claim 16, wherein said first member includes a ladder lock disposed proximate said at least one hook.

19. The multi-purpose roof and ladder device of claim 18, wherein said ladder lock includes a resilient component.

20. The multi-purpose roof and ladder device of claim 15, further including a plank stop coupled to said second member.

21. The multi-purpose roof and ladder device of claim 20, wherein said plank stop is movable.

22. The multi-purpose roof and ladder device of claim 20, wherein said plank stop includes a lever locking device.

23. The multi-purpose roof and ladder device of claim 15, wherein said second member includes first and second engaging regions;

said third member includes an engaging mechanism; and said roof attachment member includes an extended portion to prevent said engaging mechanism of said third member from moving between said first and second engaging regions of said second member while said roof attachment member is utilized.

24. The multi-purpose roof and ladder device of claim 15, further including a movable plank stop coupled to said second member.

25. The multi-purpose roof and ladder device of claim 15, wherein said first member includes first and second engagement settings, and wherein said third member is coupled to one of said first and second engagement settings of said first member.

26. The multi-purpose roof and ladder device of claim 15, wherein said second member includes a longitudinal axis and first and second engaging regions, said first engaging region pivotably connected to said first end of said first member, said second engaging region of said second member including a first set of at least one engaging slot disposed at an acute angle relative to said longitudinal axis, and a second set of at least one engaging slot disposed at an obtuse angle relative to said longitudinal axis;

said third member includes an engaging mechanism; and further including a movement restrictor adjacent said second engaging region of said second member to prevent said engaging mechanism of said third member from accidentally moving between said first and second sets of at least one engaging slot of said second engaging region of said second member.

27. A ladder securing device comprising:

a first member, a second member and a third member;

said first member coupled to said second member;

said second member coupled to said third member;

said third member coupled to said first member;

said first member coupled to a ladder hook;

said ladder hook having an opening;

a movable locking member adjacent said ladder hook; and said movable locking member having a resilient component for maintaining said locking member in a first position substantially blocking said opening of said ladder hook for locking an object within said ladder hook and for allowing compressive displacement of said locking member to a second position wherein said locking member is substantially absent from said opening of said ladder hook for releasing said object.

28. The ladder securing device of claim 27, wherein said ladder hook includes holes.

29. The ladder securing device of claim 27, further including a plank stop coupled to said second member.

30. The ladder securing device of claim 29, wherein said plank stop is movable.

31. The ladder securing device of claim 30, wherein said plank stop includes a lever locking device.

32. The ladder securing device of claim 27, further including a roof attachment member coupled to said second member.

33. The ladder securing device of claim 32, wherein said roof attachment member is movably coupled to said second member.

34. The ladder securing device of claim 33, further including a movable plank stop coupled to said second member.

35. The ladder securing device of claim 29, wherein said second member includes first and second engaging regions; and said third member includes an engaging mechanism.

36. The ladder securing device of claim 27, further including a roof attachment member.

37. The ladder securing device of claim 36, wherein said roof attachment member includes an extended portion to prevent said engaging mechanism of said third member from moving between said first and second engaging regions on said second member while said roof attachment member is utilized.

38. The ladder securing device of claim 37, wherein said roof attachment member is movably coupled to said second member.

39. The ladder securing device of claim 27, wherein said first member includes multiple engaging regions, and wherein said third member is coupled at one of said multiple engaging regions of said first member.

40. The ladder securing device of claim 27, wherein said second member includes first and second engaging regions; and said third member includes an engaging mechanism; and further comprising a movement restrictor adjacent said first and second regions of said second member to prevent said engaging mechanism of said third member from accidentally moving between said first and second regions of said second member.

* * * * *